US009506205B1

(12) United States Patent
Lee et al.

(10) Patent No.: US 9,506,205 B1
(45) Date of Patent: Nov. 29, 2016

(54) ROTARY MIXER WITH A FRONT-MOUNTED ADDITIVE DISTRIBUTOR

(71) Applicant: Caterpillar Paving Products Inc., Brooklyn Park, MN (US)

(72) Inventors: Alexis J. Lee, Saint Paul, MN (US); John E. Jorgensen, Andover, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 14/735,575

(22) Filed: Jun. 10, 2015

(51) Int. Cl.

| | |
|---|---|
| ***E01C 21/00*** | (2006.01) |
| ***B01F 7/00*** | (2006.01) |
| ***B01F 15/02*** | (2006.01) |
| ***B01F 15/00*** | (2006.01) |
| ***E01C 7/00*** | (2006.01) |
| ***E01C 19/00*** | (2006.01) |
| ***E01C 23/06*** | (2006.01) |
| ***E01C 19/25*** | (2006.01) |

(52) U.S. Cl.
CPC ..... *E01C 21/00* (2013.01); *B01F 7/00* (2013.01); *B01F 15/00389* (2013.01); *B01F 15/0216* (2013.01); *B01F 15/0227* (2013.01); *E01C 7/00* (2013.01); *E01C 19/002* (2013.01); *E01C 19/255* (2013.01); *E01C 23/065* (2013.01); *B01F 2215/0063* (2013.01)

(58) Field of Classification Search
CPC ..... E01C 23/065; E01C 21/00; E01C 7/00; E01C 19/002; E01C 19/255; B01F 2215/0063; B01F 7/00; B01F 15/00389; B01F 15/0216; B01F 15/0227; B01F 15/026
See application file for complete search history.

(56) References Cited

U.S. PATENT DOCUMENTS

| | | | | |
|---|---|---|---|---|
| 2,181,320 | A * | 11/1939 | Flynn | E01C 21/00 404/111 |
| 3,732,023 | A * | 5/1973 | Rank | E01C 21/00 404/111 |
| 4,317,642 | A | 3/1982 | Wirtgen | |
| 4,335,974 | A * | 6/1982 | Wirtgen | E01C 23/065 404/101 |
| 4,946,307 | A * | 8/1990 | Jakob | E01C 23/088 404/90 |
| 5,005,980 | A | 4/1991 | Zimmerman | |
| 5,730,549 | A * | 3/1998 | Choudin | E02D 3/005 404/75 |
| 6,416,249 | B1 * | 7/2002 | Crupi | E01C 23/065 404/75 |
| 7,004,675 | B2 | 2/2006 | Wayne | |
| 8,511,933 | B2 * | 8/2013 | Menzenbach | E01C 19/2025 404/108 |
| 2002/0172555 | A1 * | 11/2002 | Crupi | E01C 23/065 404/77 |
| 2003/0026653 | A1 * | 2/2003 | Crupi | E01C 23/065 404/75 |
| 2007/0098496 | A1 * | 5/2007 | Hall | C04B 26/26 404/94 |
| 2010/0104363 | A1 | 4/2010 | Benedetti | |
| 2014/0286706 | A1 * | 9/2014 | Klockner | B60D 1/62 404/90 |

FOREIGN PATENT DOCUMENTS

| | | |
|---|---|---|
| DE | 3731716 | 5/1992 |
| DE | 102012024769 | 6/2014 |

(Continued)

*Primary Examiner* — Abigail A Risic
(74) *Attorney, Agent, or Firm* — Andrew A. Phillips

(57) ABSTRACT

A rotary mixer has a mixing chamber with a rotor to reclaim the work surface. The rotary mixer has a supply container located on the frame adjacent to the front end thereof. The supply container contains an additive for mixing with the reclaimed work surface. A transport assembly connects the supply container to a distribution assembly. The distribution assembly is located in front of the mixing chamber and receives the additive from the transport assembly and deposits the additive on the work surface.

16 Claims, 4 Drawing Sheets

(56) References Cited

FOREIGN PATENT DOCUMENTS

| | | |
|---|---|---|
| EP | 0081194 | 4/1986 |
| EP | 1012396 | 6/2002 |
| GB | 2077331 | 12/1981 |
| WO | 9010752 | 9/1990 |
| WO | 2013131152 | 9/2013 |

* cited by examiner

ROTARY MIXER WITH A FRONT-MOUNTED ADDITIVE DISTRIBUTOR

TECHNICAL FIELD

The present disclosure relates to a rotary mixer and, in particular, a rotary mixer with a front-mounted additive distributor.

BACKGROUND

A rotary mixer is generally used as a soil reclaimer and stabilizer for developing a soil bed for various applications, such as for paving a roadway. The rotary mixer has a mixing chamber and a rotor disposed within the mixing chamber to cut, pulverize and mix soil of a mixing work surface with additives or aggregates to modify and stabilize the work surface. The additives or the aggregates are distributed in front of the rotary mixer by an auxiliary vehicle during a soil reclaiming or stabilizing operation. However, such distribution of the additives by the auxiliary vehicle may lead to higher costs. Further, dispersal of the additives varies due to environmental conditions, such as rain and wind. Moreover, tires of the rotary mixer may cause uneven distribution of the additives on the work surface, and hence cause non-uniform mixing of the additives with the reclaimed work surfaces.

European Patent Number 1012396B1 (the '396 patent) discloses a machine for stabilizing ground with a low bearing capacity. The low-bearing capacity corresponds to insufficient load-bearing capability of soil in the ground. The machine includes a driver's cab for an operator, a self-propelled frame comprising at least two axles provided with wheels and a working roll which is mounted between the two axles. A tank is provided in the working direction, immediately before the working roll, and a measuring and discharging device are connected to the tank for depositing a powdered binder on the ground. The tank disclosed in the '396 patent is a permanent structure disposed in the frame of the machine behind the driver's cab for storing the powdered binder. Further, the measuring and discharging device is also a permanent structure disposed before the working roll to deposit the powdered binder on the ground. Service and maintenance of the tank and the discharge device may be complex and time consuming.

SUMMARY OF THE DISCLOSURE

In one aspect of the present disclosure, a rotary mixer is provided. The rotary mixer has a frame defining a front end. An operator station is disposed on the frame and a mixing chamber is supported from the frame. The mixing chamber includes a rotor to reclaim a work surface. The rotary mixer includes a supply container located on the frame adjacent to the front end thereof. The supply container is configured to contain an additive for mixing with the reclaimed work surface. The rotary mixer further includes a transport assembly connecting the supply container to a distribution assembly. The distribution assembly located in front of the mixing chamber. The distribution assembly receives the additive from the transport assembly and deposits the additive on the work surface.

In another aspect of the present disclosure, a method of stabilizing a work surface by a rotary mixer is provided. The method includes moving ground engaging members of the rotary mixer over the work surface. The method further includes depositing an additive, stored in a supply container, on the work surface. The supply container is located on a frame adjacent to a front end of the rotary mixer. The method further includes moving a mixing chamber over the work surface. The mixing chamber includes a rotor to reclaim the work surface along with the additive.

In yet another aspect of the present disclosure, a rotary mixer is provided. The rotary mixer includes a frame defining a front end and a rear end. The rotary mixer further includes an operator station disposed on the frame between the front end and the rear end thereof. A set of ground engaging members is disposed adjacent to each of the front end and the rear end of the frame. The rotary mixer further includes a mixing chamber supported from the frame between the sets of ground engaging members disposed adjacent to the front end and the rear end of the frame. The mixing chamber includes a rotor to reclaim a work surface. The rotary mixer includes a supply container located on the frame adjacent to the front end thereof. The supply container is configured to contain an additive for mixing with the reclaimed work surface. The rotary mixer further includes a transport assembly connecting the supply container to a distribution assembly. The distribution assembly is located in front of the mixing chamber. The distribution assembly receives the additive from the transport assembly and deposits the additive on the work surface.

Other features and aspects of this disclosure will be apparent from the following description and the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
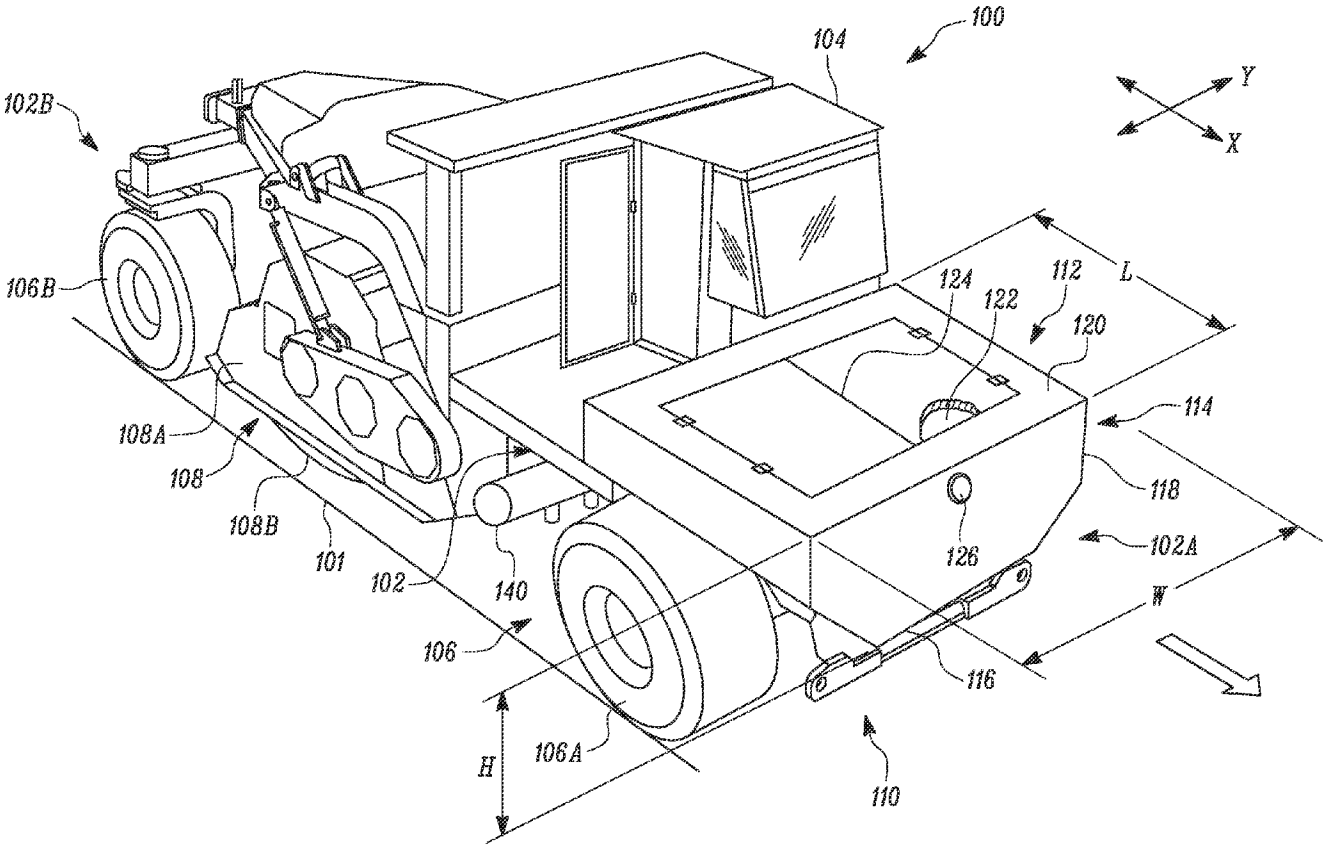
FIG. 1 is a perspective view of a rotary mixer, according to an embodiment of the present disclosure.

FIG. 1 illustrates a perspective view of a rotary mixer 100, according to an embodiment of the present disclosure. The rotary mixer 100 may be used for reclaiming and stabilizing a work surface 101. The rotary mixer 100 may also be used for preparing a ground surface or a soil bed for various purposes, such as construction of roads and buildings, or for agricultural applications.

The rotary mixer 100 includes a frame 102 to support various components of the rotary mixer 100, such as an engine (not shown), a power train (not shown) and an operator station 104. The frame 102 further defines a front end 102A and a rear end 102B. The engine, the power train and the operator station 104 are disposed between the front end 102A and the rear end 102B of the frame 102. The operator station 104 may include control levers and/or switches for an operator to control various operations, such as a reclaiming operation and forward/reverse travel of the rotary mixer 100. The rotary mixer 100 further includes a set of ground engaging members 106 disposed adjacent to each of the front end 102A and the rear end 102B of the frame 102. The set of ground engaging members 106 disposed adjacent to the front end 102A of the frame 102 is hereinafter referred as "the first set of ground engaging members 106A", and the set of ground engaging members 106 disposed adjacent to the rear end 102B of the frame 102 is hereinafter referred as "the second set of ground engaging members 106B".

In the illustrated embodiment, the ground engaging members 106 are wheels. In another embodiment, at least one of the first and second set of ground engaging members 106A, 106B may be a track. The set of ground engaging members 106 may be drivably coupled to the engine for moving the rotary mixer 100 over the work surface 101.

The rotary mixer 100 further includes a mixing chamber 108 for reclaiming and pulverizing the work surface 101. The mixing chamber 108 is supported from the frame 102 between the first set of ground engaging members 106A and the second set of ground engaging members 106B. The mixing chamber 108 includes a rotor housing 108A and a rotor 108B rotatably disposed within the rotor housing 108A. The rotor 108B is configured to contact the work surface 101 during travel of the rotary mixer 100 to reclaim and/or pulverize the work surface 101. The rotor 108B is also configured to mix reclaimed soil with various additives or aggregates deposited on the work surface 101. The rotor 108B may be drivably coupled to the engine via the power train. In an example, the rotor 108B contains a plurality of cutting tools used to mix and/or pulverize the work surface 101. In various embodiments, a height of the mixing chamber 108 with respect the work surface 101 may be adjusted by moving the mixing chamber 108 relative to the frame 102 via one or more actuators.

The rotary mixer 100 further includes a system 110 for depositing an additive 111 (shown in FIG. 2) on the work surface 101. The system 110 is configured to deposit the additive 111 on the work surface 101 during the reclaiming or pulverization operation of the rotary mixer 100. The additive 111 may be mixed with a reclaimed work surface 101A (shown in FIG. 2) to form a stable soil base for various purposes, such as for paving roads and constructing buildings. Various traditional additives, such as portland cement, lime, fly ash and cement kiln dust and various non-traditional additives, such as polymer base products, fiber reinforcement, calcium chloride and sodium chloride are used for mixing with the reclaimed work surface 101A. Such additives help in stabilization of the work surface 101.

The system 110 includes a supply container 112 configured to contain the additive 111 for mixing with the reclaimed work surface 101A. The supply container 112 is located on the frame 102 adjacent to the front end 102A thereof. The supply container 112 is further located on the frame 102 in front of the operator station 104. In another embodiment, the supply container 112 may be detachably located within a space 114 defined by the frame 102 in front of the operator station 104.

In an embodiment, the space 114 may be defined by a length 'L' measured along a longitudinal axis 'X' of the rotary mixer 100 and a width 'W' measured along a lateral axis 'Y' of the rotary mixer 100. The longitudinal axis 'X' may further correspond to a travelling direction of the rotary mixer 100. The length 'L' of the space 114 may extend between the front end 102A of the frame 102 and the operator station 104 and the width 'W' may extend between the sides of the rotary mixer 100. The width 'W' of the space 114 may be substantially equal to or less than an overall width of the rotary mixer 100.

In an embodiment, the supply container 112 includes a bottom member 116 and a plurality of side members 118 extending from the bottom member 116 to contain the additive 111 therein. The supply container 112 further includes a top member 120 enclosing the supply container 112 from a top thereof. A design and dimensions of the supply container 112 are defined based on the length 'L' and the width 'W' of the space 114 available in front of the operator station 104. The supply container 112 is further designed to optimally utilize the space 114 available in front of the operator station 104 without affecting visibility of the operator sitting in the operator station 104. The supply container 112 may also have a height 'H' extending between the bottom member 116 and the top member 120. The height 'H' is optimally chosen to accommodate a maximum amount of the additive 111 within the supply container 112 and also provide required visibility to the operator. The supply container 112 further includes an opening 122 for receiving the additive 111 therethrough. Specifically, the additives, such as portland cement, lime, fly ash and cement kiln dust, may be received through the opening 122. In one embodiment, the opening 122 may be defined in the top member 120. In other embodiments, the opening 122 may be defined in one of the plurality of side members 118. It may also be contemplated that the opening 122 may be defined at any alternative location in the supply container 112 to receive the additive 111. The opening 122 is closed by a closing member 124 to protect the additive 111 contained in the supply container 112 from moisture and other environmental factors that may contaminate the additive 111. In other embodiments, the top of the supply container 112 may be opened (i.e. without the top member 120 and the closing member 124) to receive any type of additives 111. In an exemplary embodiment, the supply container 112 is large enough so that the additive 111 may be loaded in the supply container 112 via a wheel loader or machines having tilting truck beds.

The supply container 112 may further include a fill port 126 defined in one of the plurality of side members 118 to receive the additive 111 therethrough. Specifically, a liquid type additive may be received through the fill port 126. The fill port 126 may be further configured to allow a controlled flow of the liquid type additive to the supply container 112.

The construction of the supply container 112 described above is exemplary. It may be contemplated that a supply container having any alternative shape, size or configuration may be disposed on the frame 102 within the space 114 available in front of the operator station 104.

Figure 2:
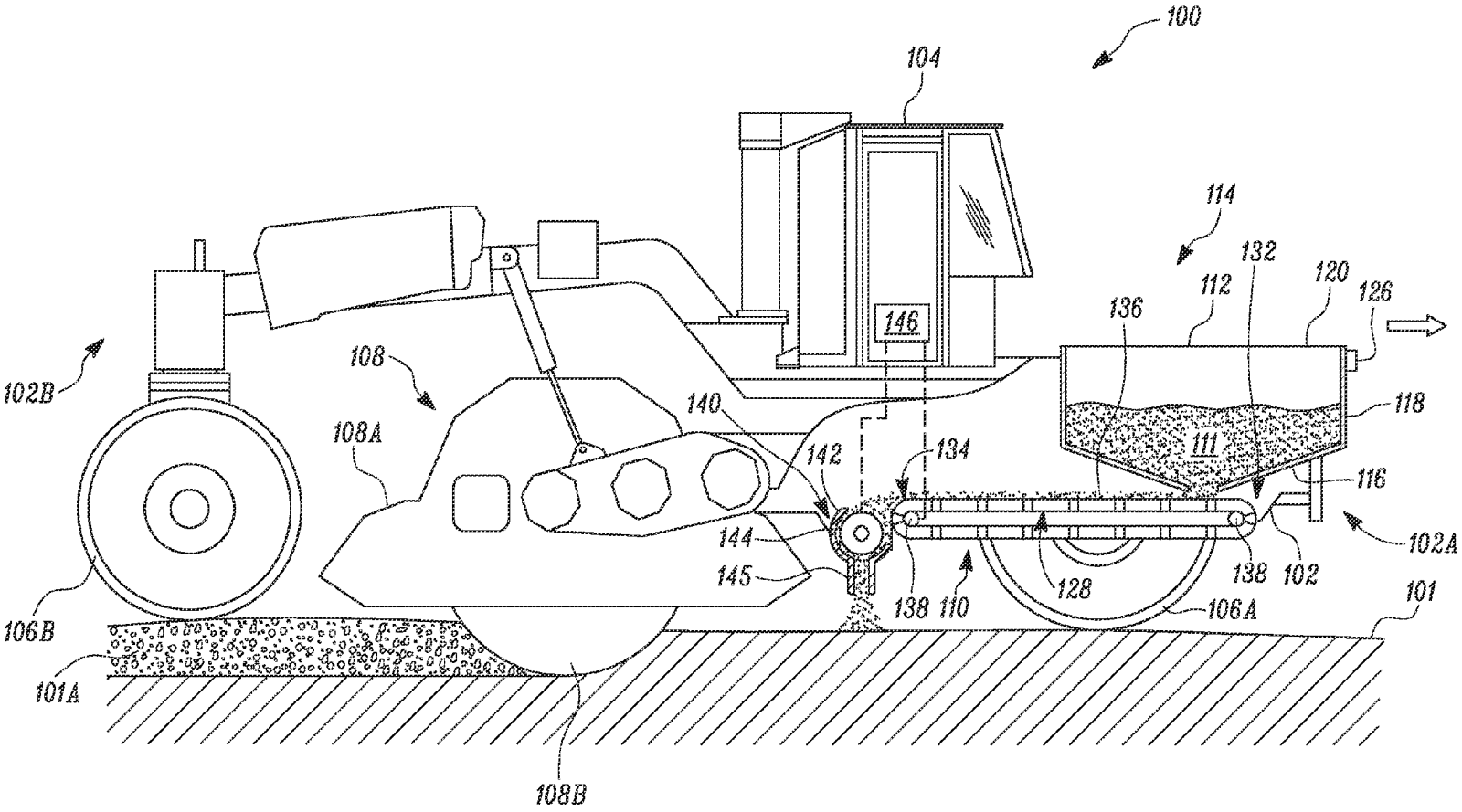
FIG. 2 is a partial sectional view of the rotary mixer showing a system for depositing an additive on a work surface, according to an embodiment of the present disclosure.

FIG. 2 illustrates a side view of the rotary mixer 100 showing the system 110, according to an embodiment of the present disclosure. The system 110 further includes a transport assembly 128 connecting the supply container 112 to a distribution assembly 140. The transport assembly 128 is coupled to the frame 102 such that the transport assembly 128 communicates with the supply container 112 to receive the additive 111 therefrom. The transport assembly 128 is further configured to transport the additive 111 from the supply container 112 towards the front of the mixing chamber 108. The transport assembly 128 is at least partially disposed adjacent to the bottom member 116 of the supply container 112.

In an embodiment, the transport assembly 128 extends along the longitudinal axis 'X' of the rotary mixer 100. The transport assembly 128 further extends between a first end 132 and a second end 134. The first end 132 of the transport assembly 128 is disposed within the supply container 112 and the second end 134 is disposed in front of the mixing chamber 108. The transport assembly 128 includes a conveyor 136 designed to move the additive 111 from the supply container 112 to the distribution assembly 140. The conveyor 136 may be a belt conveyor or any other type of conveyor known in the art. The conveyor 136 may be configured to move around a pair of drive members 138. One of the pair of drive members 138 may be disposed adjacent to the first end 132 of the transport assembly 128 and another of the pair of drive members 138 may be disposed adjacent to the second end 134 of the transport assembly 128. At least one of the drive members 138 may be actuated by an electric system or a hydraulic system of the rotary mixer 100. In case of the electric system, an electric motor may be used to rotate one of the drive members 138, and in case of the hydraulic system, a hydraulic motor may be used to rotate one of the drive members 138. It may also be contemplated that one of the drive members 138 may be configured to receive power from the power train or the engine of the rotary mixer 100. In an embodiment, one of the drive members 138 may be rotated based on an input from the operator. As one of the drive members 138 rotates, the conveyor 136 disposed on the drive members 138 may move around the pair of drive members 138. Thus, the additive 111 may be moved from the supply container 112 towards the front of the mixing chamber 108. In the illustrated embodiment, the transport assembly 128 is disposed parallel to the longitudinal axis 'X' of the rotary mixer 100. In various other embodiments, the transport assembly 128 may be disposed at an angle with respect the longitudinal axis 'X' of the rotary mixer 100.

In an embodiment, the drive member 138 disposed adjacent to the second end 134 of the transport assembly 128 may be rotatably supported on the frame 102. Similarly, the drive member 138 disposed adjacent to the first end 132 of the transport assembly 128 may be rotatably supported on the frame 102 or the supply container 112. In various embodiments, the pair of drive members 138 may be coupled at any location in the frame 102 to support the transport assembly 128 without interfering with any other components of the rotary mixer 100.

The distribution assembly 140 is located in front of the mixing chamber 108. The distribution assembly 140 receives the additive 111 from the transport assembly 128 and deposit the additive 111 on the work surface 101. Specifically, the distribution assembly 140 is disposed between the first set of ground engaging members 106A and the mixing chamber 108.

In an embodiment, the distribution assembly 140 contains an auger 144 to control the amount additive being deposited on the work surface 101. The distribution assembly may further include a housing 142 for enclosing the auger 144 therein. The auger 144 is rotatably disposed within the housing 142 and configured to selectively allow a desired amount of the additive 111 to be deposited on the work surface 101. A speed of the auger 144 is regulated by a controller 146. In an exemplary embodiment, the auger 144 may be coupled to an actuator (not shown). The actuator may be supported on the housing 142 or the frame 102. The actuator may be further communicated with the controller 146 to control the speed of the auger based on an input received from the operator. In an example, the actuator may be an electric motor or a hydraulic motor. The distribution assembly 140 further includes multiple outlet members 145 (only one outlet member 145 is shown in FIG. 2), extending from the housing 142, to receive the additive 111 therethrough. The outlet members 145 may be adapted to extend towards the work surface 101. A free end of the outlet member 145 may be disposed above the work surface 101 to deposit the additive 111 on the work surface 101. The outlet members 145 may further extend towards the front of the mixing chamber 108 and disposed adjacent to the rotor housing 108A. In other embodiments, the outlet members 145 may be movably coupled to the housing 142 such that a position of the outlet members 145 with respect to the work surface 101 and the mixing chamber 108 may be adjusted.

The controller 146 is configured to measure and control an amount of the additive 111 being deposited on the work surface 101. The controller is in communication with the distribution assembly 140. Specifically, the controller 146 may be communicated with the actuator to control actuation of the auger 144. Thus, the controller 146 may control the actuation of the auger 144 based on an input from the operator to control an amount of the additive 111 deposited on the work surface 101. In an embodiment, the controller 146 may be a machine controller used in the rotary mixer 100 for controlling various operations of the rotary mixer 100. In another embodiment, the controller 146 may be a separate controller configured for the actuation of the distribution assembly 140. The separate controller may be further interfaced with the machine controller of the rotary mixer 100 to control actuation of the distribution assembly 140 based on various operating conditions of the rotary mixer 100, such as a speed of the rotary mixer 100 and a load acting on the rotary mixer 100.

In various embodiments, one or more sensors may be disposed on the distribution assembly 140 to generate signals indicative of various operating parameters of the distribution assembly 140. The one or more sensors may be further communicated with the controller 146 to determine the operating parameters. Thus, the controller 146 may actuate the distribution assembly 140 based on the determined operating parameters of the distribution assembly 140 to measure and control the amount of the additive 111 deposited on the work surface 101. In an example, a ratio between a volume of the additive 111 and a volume of soil in the reclaimed work surface 101A may be determined to control the amount of the additive 111 deposited on the work surface 101.

In another embodiment, the controller 146 is configured to be in communication with the transport assembly 128 to control an amount of the additive 111 moved from the supply container 112 to the distribution assembly 140. In an example, the controller 146 may communicate with at least one of the drive members 138 to control a speed of the conveyor 136. Thus, an amount of the additive 111 transported from the supply container 112 to the distribution assembly 140 may be regulated.

Figure 3:
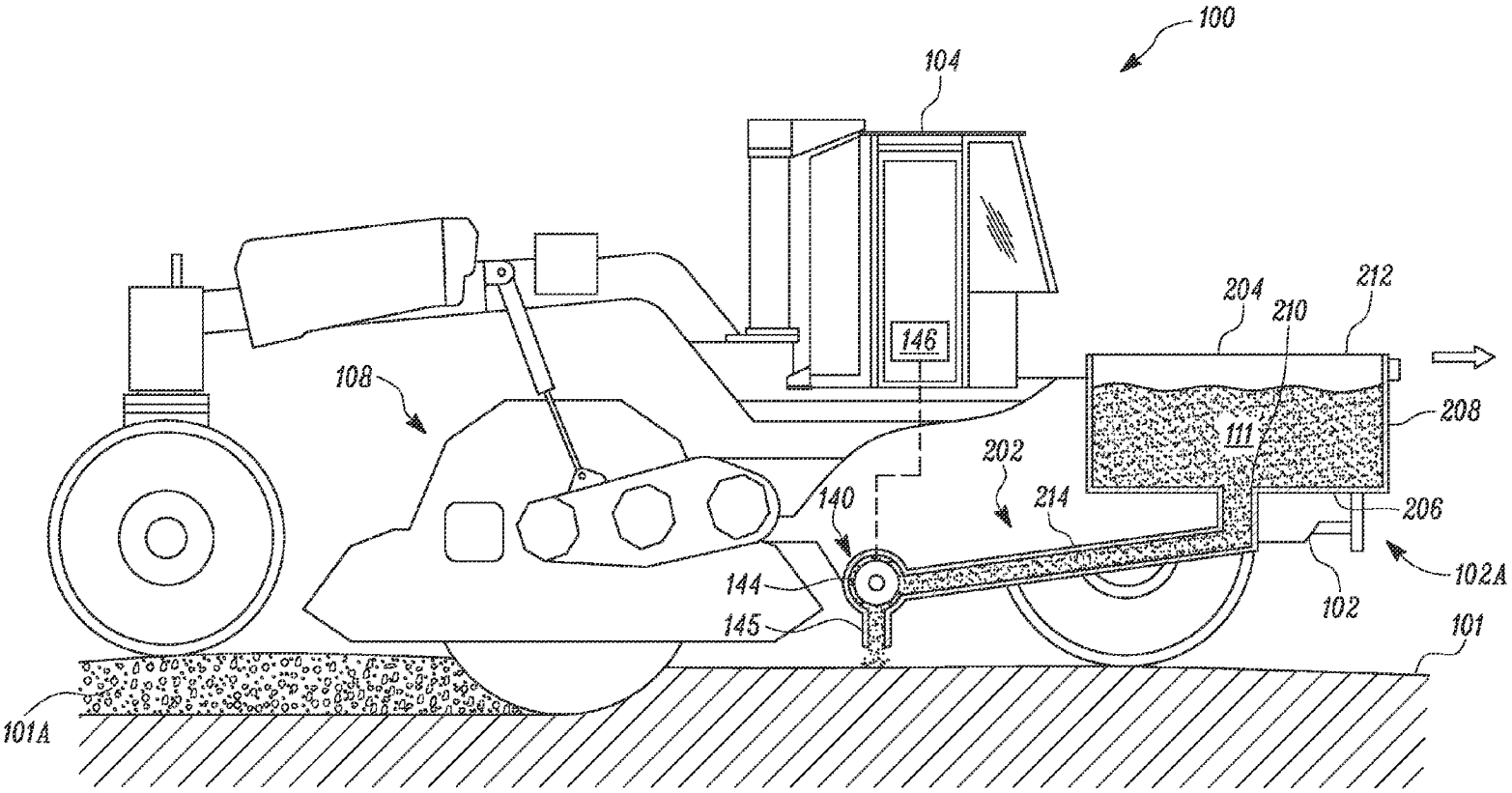
FIG. 3 is a partial sectional view of the rotary mixer showing a system for depositing the additive on the work surface, according to another embodiment of the present disclosure.

FIG. 3 illustrates a partial sectional view of the rotary mixer 100 showing a system 202 for depositing the additive 111 on the work surface 101, according to another embodiment of the present disclosure. The system 202 includes a supply container 204 for containing the additive 111. The supply container 204 is located on the frame 102 adjacent to the front end 102A thereof. The supply container 204 is further located on the frame 102 in front of the operator station 104. In an embodiment, the supply container 204 includes a bottom member 206 and a plurality of side members 208 extending from the bottom member 206 to contain the additive 111 therein. The bottom member 206 includes an outlet port 210 to allow the additive 111 contained in the supply container 204 to pass therethrough. The supply container 204 further includes a top member 212 enclosing the supply container 204 from a top thereof. The supply container 204 further includes an opening (not shown) defined in the top member 210 for receiving the additive 111 therethrough.

The system 202 further includes the distribution assembly 140 disposed in front of the mixing chamber 108 to receive the additive 111 from the supply container 204 via a transport assembly 214, such as a channel. The transport assembly 214 gravity feeds the additive 111 from the supply container 204 to the distribution assembly 140. The transport assembly 214 is disposed below the frame 102. One end of the transport assembly 214 is coupled to the outlet port 210 of the supply container 204 and another end of the transport assembly 214 is coupled to the distribution assembly 140. The additive 111 contained in the supply container 204 passes through the transport assembly 214 due to gravity and communicates with the distribution assembly 140. The additive 111 is further deposited on the work surface 101.

INDUSTRIAL APPLICABILITY

The present disclosure relates to the system 110 for depositing the additive 111 on the work surface 101 during the reclaiming operation of the rotary mixer 100. The system 110, including the supply container 112, the transport assembly 128 and the distribution assembly 140, is configured to deposit the additive 111 in front of the mixing chamber 108 during the reclaiming operation. Specifically, the supply container 112, the transport assembly 128 and the distribution assembly 140 are configured to be detachably disposed on the frame 102. Further, the supply container 112 is disposed on the frame 102 to optimally utilize the space 114 available in front of the operator station 104. The present disclosure also relates to a method 300 for reclaiming the work surface 101 by the rotary mixer 100.

Figure 4:
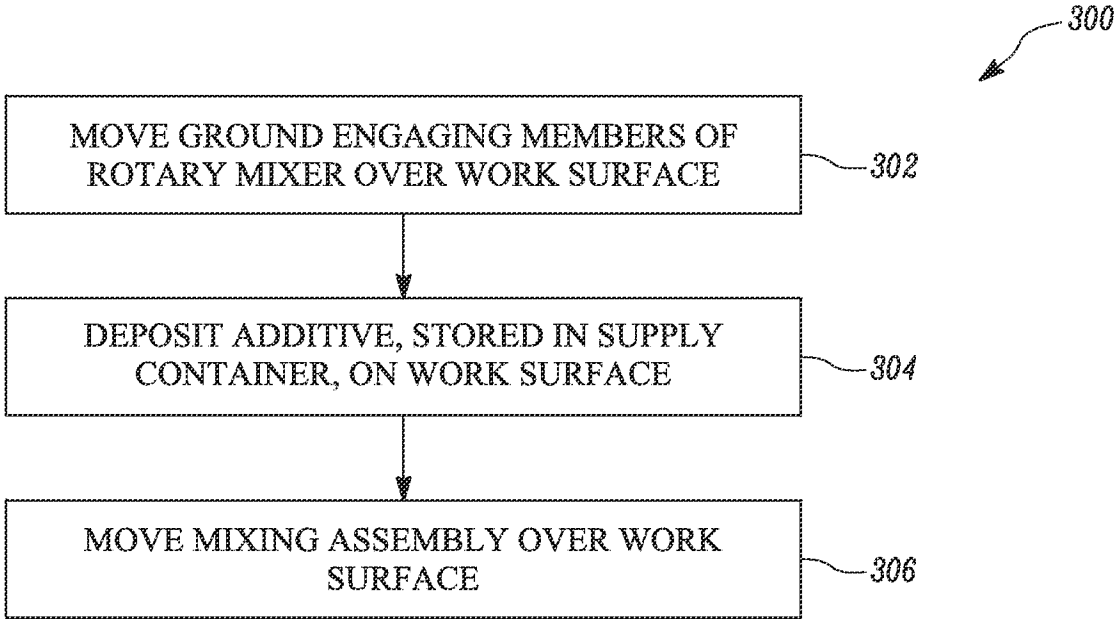
FIG. 4 is a flowchart of a method of stabilizing the work surface, according to an embodiment of the present disclosure.

FIG. 4 illustrates the method 300 of stabilizing the work surface 101, according to an embodiment of the present disclosure. At step 302, the method 300 includes moving the ground engaging members 106 over the work surface 101. The engine of the rotary mixer 100 is activated to drive one or both of the first and second set of ground engaging members 106A, 106B, thereby moving the rotary mixer 100 over the work surface 101.

At step 304, the method 300 includes depositing the additive 111, stored in the supply container 112, on the work surface 101 in front of the mixing chamber 108. The additive 111 is loaded in the supply container 112 through the opening 122 and/or the fill port 126 depending on the type of additive. The transport assembly 128 may be actuated by the operator to move the additive 111 from the supply container 112 to the distribution assembly 140. In an embodiment, the controller 146 may regulate the speed of the conveyor 136 such that the amount of the additive 111 transported from the supply container 112 to the distribution assembly 140 is controlled. Further, the speed of the auger 144 is regulated by the controller 146 to control the amount of the additive 111 deposited on the work surface 101. The amount of the additive 111 deposited on the work surface 101 may be controlled based on various parameters including, but not limited to, a type of the soil, a type of the additive 111, a speed of the rotary mixer 100 and a speed of the rotor 108B.

At step 306, the method 300 includes moving the mixing chamber 108 over the work surface 101. The rotor 108B disposed within the rotor housing 108A of the mixing chamber 108 is driven by the engine. Further, the mixing chamber 108 is moved towards the work surface 101 to contact the rotor 108B with the work surface 101 and to reclaim the work surface 101. As the rotary mixer 100 moves over the work surface 101, the rotor 108B rotates and reclaims or pulverizes the work surface 101. The rotor 108B further mixes the reclaimed or pulverized soil with the additive 111 deposited on the work surface 101 in front of the mixing chamber 108. The speed of the rotor 108B may be controlled to mix the reclaimed work surface 101A with the additive 111 deposited in front of the mixing chamber 108. Further, mixing of the additive 111 with the reclaimed work surface 101A may vary based on the speed of the rotary mixer 100 and the amount of the additive 111 deposited on the work surface 101. A compactor (not shown) may further follow the rotary mixer 100 to compact the reclaimed work surface 101A.

According to the present disclosure, the system 110 including, the supply container 112, the transport assembly 128 and the distribution assembly 140, is a temporary structure disposed on the frame 102 of the rotary mixer 100. The system 110 may be disposed on the frame 102 of the rotary mixer 100 only if the reclaiming operation requires addition of the additive 111 with the reclaimed work surface 101A. In such applications, the supply container 112 may be detachably disposed on the frame 102 in front of the operator station 104. Further, the transport assembly 128 and the distribution assembly 140 may be detachably coupled to the frame 102. Mounting provisions may be provided on the frame 102 to detachably couple the supply container 112, the transport assembly 128 and the distribution assembly 140 therewith.

Thus, the rotary mixer 100 may be optimally used for various applications such as the reclaiming and/or the stabilizing operation. The system 110 may be removed from the rotary mixer 100 during an operation not requiring any additives. This reduces a load on the rotary mixer 100 and improves fuel efficiency. Further, the detachable system 110 may also improve the productivity of the rotary mixer 100.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A rotary mixer comprising:

a frame defining a front end;

an operator station disposed on the frame;

a mixing chamber supported from the frame, the mixing chamber having a rotor to reclaim a work surface;

a supply container located on the frame in front of the mixing chamber, the supply container configured to contain an additive for mixing with the reclaimed work surface and having an opening in a bottom surface;

a transport assembly connecting the supply container to a distribution assembly wherein the transport assembly receives additive through the opening in the bottom surface; and the distribution assembly located in front of the mixing chamber and at a distance from the supply container, the distribution assembly receiving the additive from the transport assembly and depositing the additive on the work surface.

2. The rotary mixer of claim 1, further comprising a controller configured to measure and control an amount of the additive being deposited on the work surface.

3. The rotary mixer of claim 1, wherein the transport assembly gravity feeds the additive from the supply container to the distribution assembly.

4. The rotary mixer of claim 1, wherein the transport assembly includes a conveyor designed to move the additive from the supply container to the distribution assembly.

5. The rotary mixer of claim 4 further comprising a controller configured to control an amount of the additive moved from the supply container to the distribution assembly.

6. The rotary mixer of claim 1, wherein the supply container is located in front of the operator station.

7. The rotary mixer of claim 1, wherein the distribution assembly contains an auger to control an amount of the additive being deposited on the work surface.

8. The rotary mixer of claim 7 further comprising a controller configured to control the speed of the auger.

9. A rotary mixer comprising:

a frame defining a front end and a rear end;

an operator station disposed on the frame between the front end and the rear end thereof;

a set of ground engaging members disposed adjacent to each of the front end and the rear end of the frame;

a mixing chamber supported from the frame between the sets of ground engaging members disposed adjacent to the front end and the rear end of the frame, the mixing chamber having a rotor to reclaim a work surface;

a supply container located on the frame in front of the mixing chamber, the supply container configured to contain an additive for mixing with the reclaimed work surface and having an opening in a bottom surface;

a transport assembly connecting the supply container to a distribution assembly wherein the transport assembly receives additive through the opening in the bottom surface; and the distribution assembly located in front of the mixing chamber and at a distance from the supply container, the distribution assembly receiving the additive from the transport assembly and depositing the additive on the work surface.

10. The rotary mixer of claim 9 further comprising a controller configured to measure and control an amount of the additive being deposited on the work surface.

11. The rotary mixer of claim 9, wherein the transport assembly gravity feeds additive from the supply container to the distribution assembly.

12. The rotary mixer of claim 9, wherein the transport assembly includes a conveyor designed to move additive from the supply container to the distribution assembly.

13. The rotary mixer of claim 12 further comprising a controller configured to control an amount of the additive moved from the supply container to the distribution assembly.

14. The rotary mixer of claim 9, wherein the supply container is located in front of the operator station.

15. The rotary mixer of claim 9, wherein the distribution assembly contains an auger to control an amount of the additive being deposited on the work surface.

16. The rotary mixer of claim 15 further comprising a controller configured to control the speed of the auger.

* * * * *